US005381870A

United States Patent [19]

Kaufman

[11] Patent Number: 5,381,870

[45] Date of Patent: Jan. 17, 1995

[54] MOTORIZED SKATEBOARD APPARATUS

[76] Inventor: Russell D. Kaufman, 990 W. 10th, Junction City, Oreg. 97448

[21] Appl. No.: 55,330

[22] Filed: May 3, 1993

[51] Int. Cl.[6] ..... A63C 17/12

[52] U.S. Cl. ..... 180/181; 280/87.042; 2/160

[58] Field of Search ..... 180/180, 181; 280/87.042, 87.041, 11.115; 2/17, 160, 161.1

[56] References Cited

U.S. PATENT DOCUMENTS

| | | | |
|---|---|---|---|
| 4,047,727 | 9/1977 | Holladay et al. | 280/87.042 |
| 4,069,881 | 1/1978 | Shiber | 180/181 |
| 4,073,356 | 2/1978 | Schlicht | 180/181 |
| 4,094,372 | 6/1978 | Notter | 180/181 |
| 4,131,290 | 12/1978 | McMillan | 180/180 X |
| 4,143,728 | 3/1979 | Shiber | 180/181 |
| 5,020,621 | 6/1991 | Martin | 180/180 X |
| 5,048,632 | 9/1991 | Battel | 180/181 |
| 5,220,690 | 6/1993 | Hoos | 2/160 X |

FOREIGN PATENT DOCUMENTS

| | | | |
|---|---|---|---|
| 2604915 | 4/1988 | France | 180/181 |
| 2653348 | 4/1991 | France | 180/181 |
| 3205379 | 8/1983 | Germany | 180/181 |

*Primary Examiner*—Brian L. Johnson

*Attorney, Agent, or Firm*—E. Michael Combs

[57] ABSTRACT

A motorized skateboard includes a tubular frame having a first and second axle mounted in a parallel relationship about opposed ends of the frame, with a drive motor directed through a drive belt to a rear driven sprocket. An optional configuration of the invention utilizes the rear driven sprocket mounted to a constant velocity joint to permit rear steerage of the skateboard. The skateboard is arranged with pivoted front arms as required to provide for shock-absorbing suspension to the skateboard structure. The utilization of an independent front suspension is cooperative with a tapered rear roller support wheel structure to permit steerage of the organization. The independent front suspension includes frontal steering controlled by the front boot including a tie rod and spindle configuration.

4 Claims, 6 Drawing Sheets

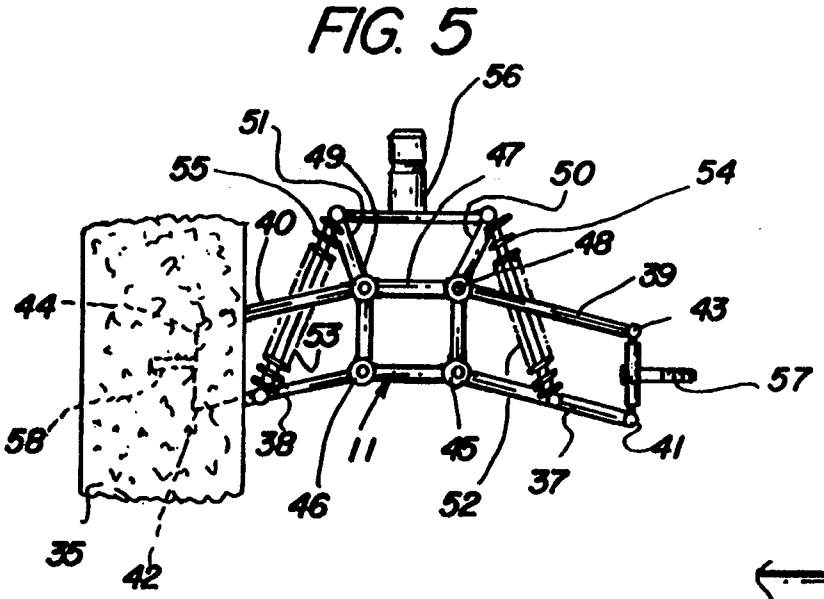
FIG. 6
FIG. 5
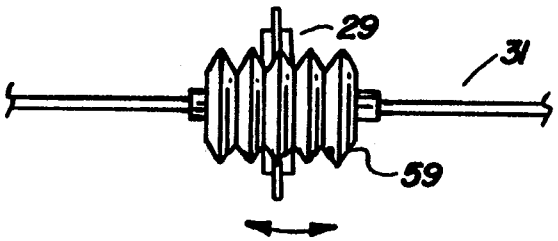
FIG. 7

MOTORIZED SKATEBOARD APPARATUS

BACKGROUND OF THE INVENTION

1. Field of the Invention

The field of invention relates to skateboard apparatus, and more particularly pertains to a new and improved motorized skateboard apparatus wherein the same utilizes an internal combustion engine to effect motivation of the skateboard structure.

2. Description of the Prior Art

A motorized skateboard structure of various types have been utilized throughout the prior art and exemplified in the U.S. Pat. No. 4,143,728 utilizing a drive motor operative to drive the rear wheels of an associated skateboard structure wherein similarly, U.S. Pat. No. 4,073,356 to Schlicht sets forth a motorized skateboard having a mounting board.

U.S. Pat. No. 4,094,372 to Notter sets forth a motorized skateboard having a rearwardly mounted drive motor.

As such, it may be appreciated that there continues to be a need for a new and improved motorized skateboard as set forth by the instant invention which addresses both the problems of ease of use as well as effectiveness in construction providing for a skateboard formed with suspension and drive components to enhance ease of mobility and comfort in use and in this respect, the present invention substantially fulfills this need.

SUMMARY OF THE INVENTION

In view of the foregoing disadvantages inherent in the known types of skateboard apparatus now present in the prior art, the present invention provides a motorized skateboard apparatus wherein the same is directed to a self-propel led skateboard structure permitting ease of maneuverability to the skateboard in use. As such, the general purpose of the present invention, which will be described subsequently in greater detail, is to provide a new and improved motorized skateboard apparatus which has all the advantages of the prior art skateboard apparatus and one of the disadvantages.

To attain this, the present invention provides a motorized skateboard including a tubular frame having a first and second axle mounted in a parallel relationship about opposed ends of the frame, with a drive motor directed through a drive belt to a rear driven sprocket. An optional configuration of the invention utilizes the rear driven sprocket mounted to a constant velocity joint to permit rear steerage of the skateboard. The skateboard is arranged with pivoted front arms as required to provide for shock-absorbing suspension to the skateboard structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in invention that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved motorized skateboard apparatus which has all the advantages of the prior art skateboard apparatus and none of the disadvantages.

It is another object of the present invention to provide a new and improved motorized skateboard apparatus; which may be easily and efficiently manufactured and marketed.

It is a further object of the present invention to provide a new and improved motorized skateboard apparatus which is of a durable and reliable construction.

Still yet another object of the present invention is to provide a new and improved motorized skateboard apparatus; which provides in the apparatuses and methods of the prior art some of the advantages thereof, while simultaneously overcoming some of the disadvantages normally associated therewith.

These together with other objects of the inventions, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an orthographic frontal view of the modified aspect of the invention.

FIG. 6 is an orthographic side view of the skateboard structure utilizing a constant velocity joint.

FIG. 7 is an orthographic view of flexible polymeric joint to be substituted in use of a constant velocity joint constructed of a series of coaxially aligned adjacent discs.

DESCRIPTION OP THE PREFERRED EMBODIMENT

Figure 1:
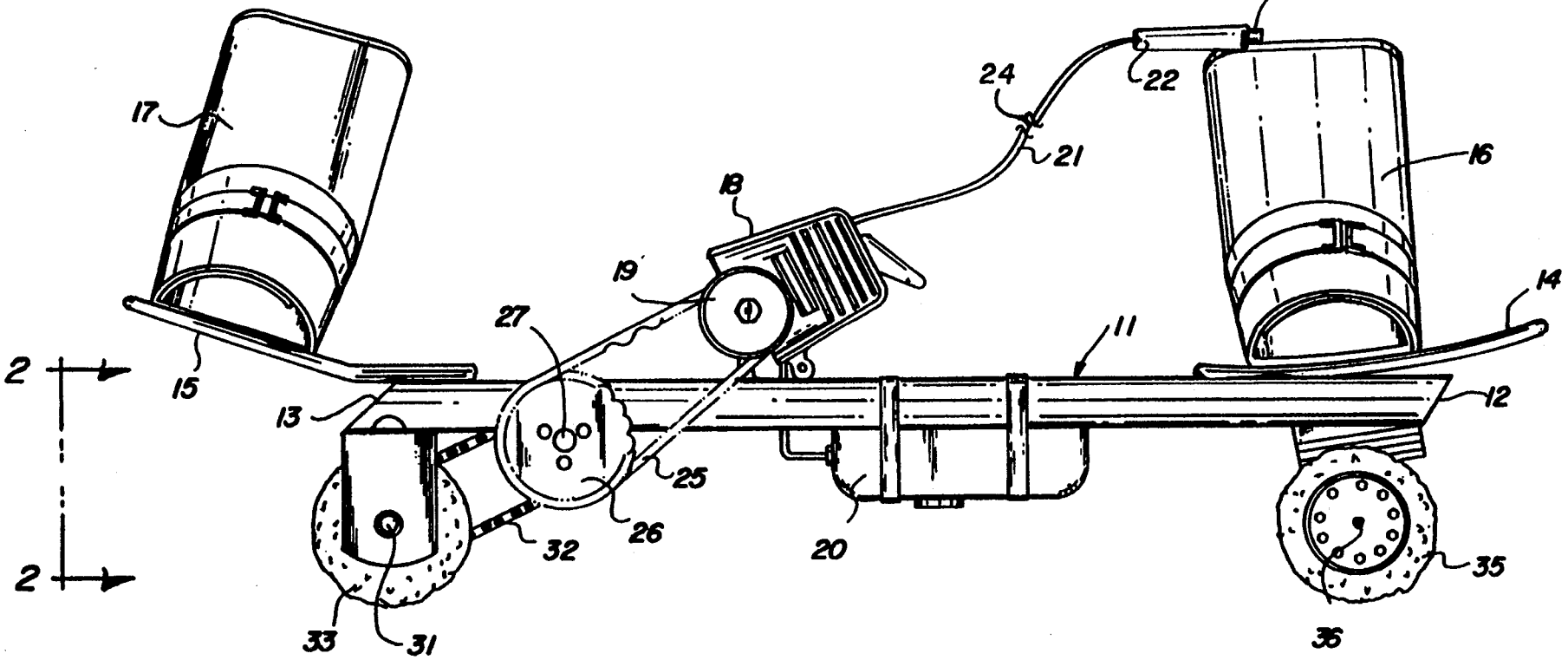
FIG. 1 is an orthographic side view of the skateboard apparatus of the invention.
Figure 2:
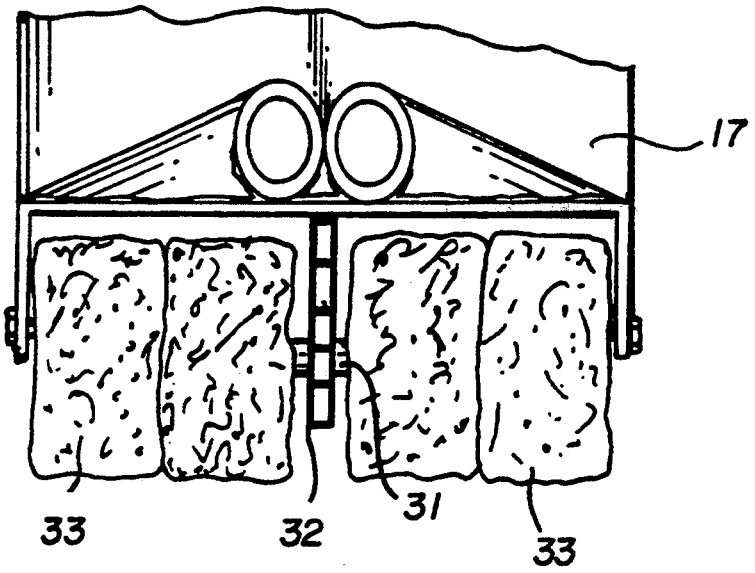
FIG. 2 is an orthographic rear view of the invention.

With reference now to the drawings, and in particular to FIGS. 1 to 10 thereof, a new and improved motorized skateboard apparatus embodying the principles and concepts of the present invention and generally designated by the reference numeral 10 will be described.

More specifically, the motorized skateboard apparatus 10 of the instant invention essentially comprises a rigid support tubular frame 11 having a first end 12 spaced from a second end 13. First extension flange 14 extends forwardly of the first end 12 to mount a first flange boot 16 thereon in a fixed relationship. A second extension flange 15 extending and projecting beyond the second end 13 mounts fixedly a second flange boot 17. A drive motor 18 mounted to the tubular frame 11 between the first and second ends 12 and 13 includes an output pulley or sprocket 19 operative through a fuel tank 20 to effect operation of the drive motor 18 of an internal combustion type. A throttle cable sheath 21 is directed into a handle 22 that includes a cable button 23 in fixed communication with a flexible cable 24 directed through the sheath 21 to effect speed control the drive motor 18. A drive belt 25 directed from the output pulley 19 is directed to a first driven sprocket 26 positioned below the frame 11 mounted to a first driven shaft 27. A second driven sprocket 28 mounted to the first driven shaft 27 includes a drive chain 32 directed from the second sprocket 28 to a third driven sprocket 29, with the second and third sprockets 28 and 29 mounted about a second axle 31. First wheel pairs 33 and second wheel pairs 35 are mounted about the respective second axle and first axle 36.

Figure 3:
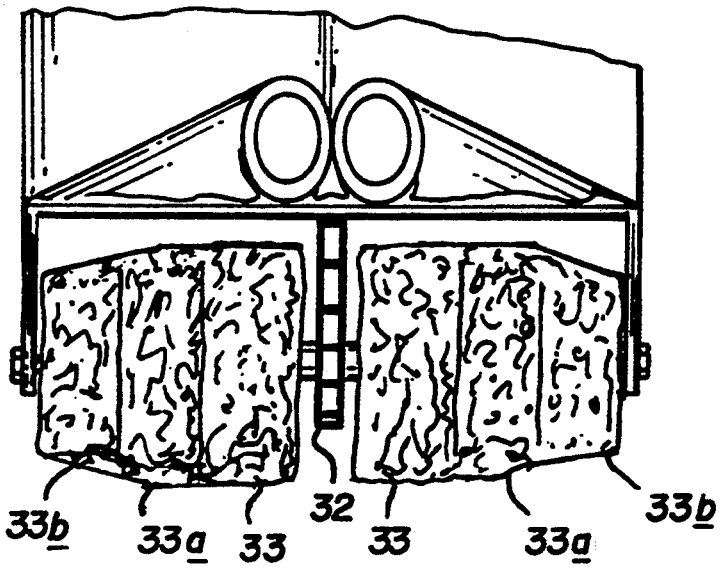
FIG. 3 is an orthographic rear view of the tapered rear wheel structure utilized by the invention.

For employment of the independent front suspension of a type as indicated in FIG. 3, the rear first wheel pairs 33 on the axle 31 on opposed sides of the sprocket drive chain 32 are tapered to include an innermost wheel 33 of a first diameter, a medial wheel **33*a* of a second diameter, and an outer wheel 33*b* of a third diameter, wherein the third diameter is less than the second diameter and the second diameter is less than the first diameter, as indicated in FIG. 3**.

Figure 4:
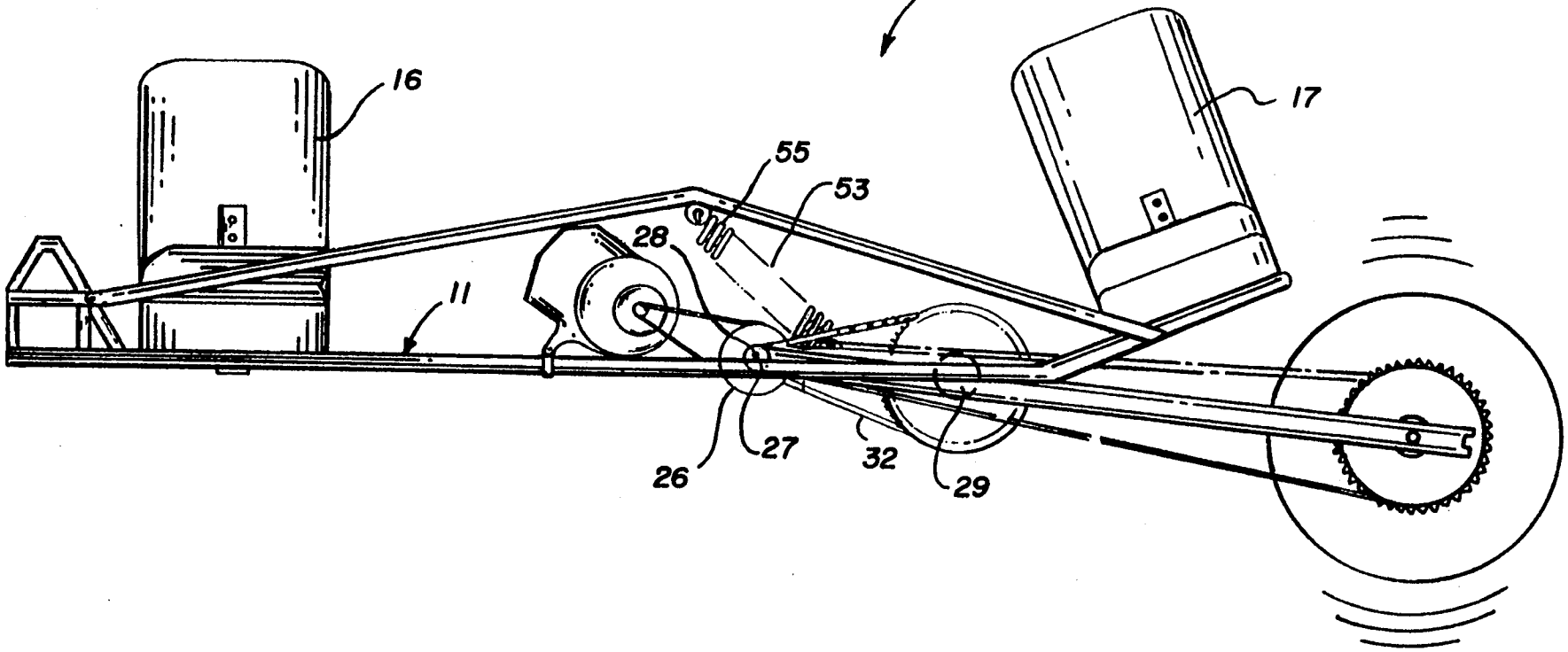
FIG. 4 is an orthographic side view of a modified aspect of the invention.
Figure 8:
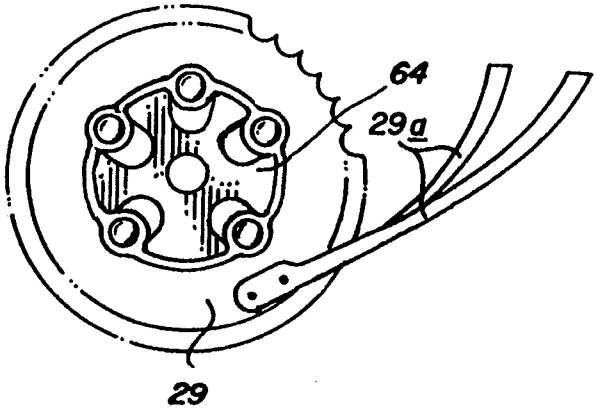
FIG. 8 is an orthographic side view of a typical constant velocity joint utilized by the invention.
Figure 9:
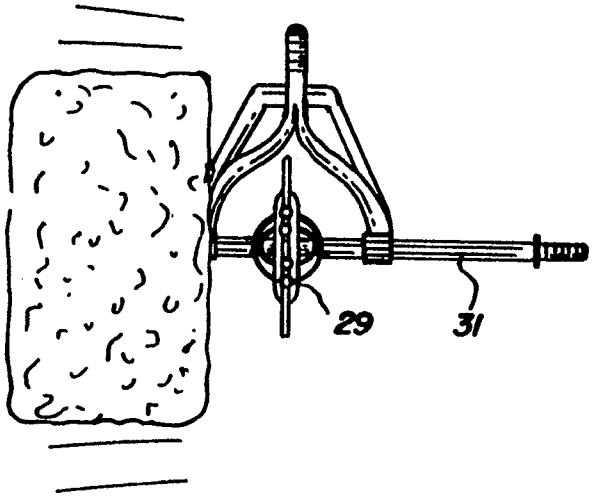
FIG. 9 is an orthographic rear view of a constant open velocity joint for utilization by the invention.

The invention as illustrated in FIG. 4 for example indicated as **10*a* includes a reinforced tubular framework having forward suspension, including a right lower arm 37 and a left lower arm 38 oriented orthogonally relative to the frame 11, with a left upper arm and a right upper arm 39 spaced above the respective left and right lower arms. A right lower joint 41 is mounted at an outer distal end of the right lower arm, with a left lower joint 42 formed at an outer end portion of the left lower arm 38. A right upper joint 43 is mounted to an outer distal end of the right upper arm, with a left upper joint 44 mounted to an outer distal end of the left upper arm 40. A lower right pivot 44 and a lower left pivot 46 pivotally mount the respective right and left lower arms 37 and 38 to the frame 11. An upper stabilizer arm 47 joins the right and left upper arms 39 and 40 about respective upper right and left pivots 48 and 49. A right shock tower 50 and a left shock tower 51 mount respective right and left fluid dampeners 52 and 53 having respective right and left coil springs 54 and 55 mounted surroundingly thereabout to provide for shock absorption and dampening of the wheel pairs 35 about respective right and left spindles 57 and 58**.

The second axle 31 mount the rear wheels 35. A constant velocity joint 59 may be mounted intermediate the second axle 31 (see FIGS. 6, 7, and 11 for example). The second axle 31 having a constant velocity joint medially thereof permits rear steerage of the organization and if desired, a support arm 60 extending below the frame 11 includes a support arm extension 61 at an obtuse angle thereto, with a free distal end of the extension 61 positioned adjacent a resilient arm abutment 62 having a concave recess 63 to provide a second pivot point to the rear or second axle 31 and the associated structure therewith. The guides **29*a* on opposed sides of the sprocket 29 align the sprocket by rubbing contact therewith, with the sprocket as indicated of a modified construction having a central constant velocity joint 64** permitting a pivot steerage to the sprocket structure.

Figure 10:
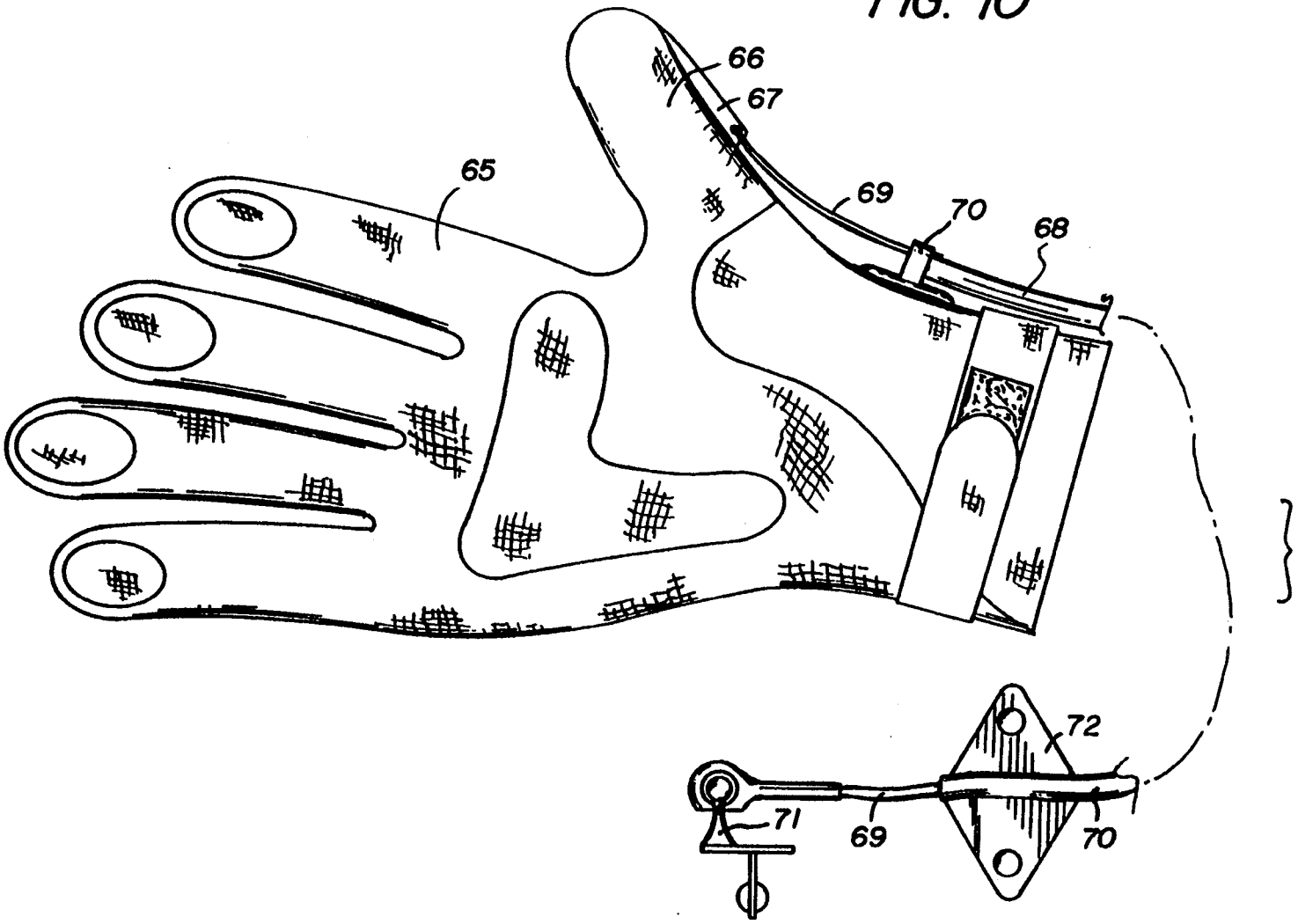
FIG. 10 is an orthographic view of a throttle control switch structure utilized by the invention.

The FIG. 10 indicates the use of a driving glove 65 arranged for utilization by an individual in use of the invention, wherein the driving glove 65 includes a thumb socket 66 having a thumb socket flange 67. A cable sheath 68 includes a cable sheath mount 70 mounted to the glove 65 in adjacency to the thumb socket. A cable 69 is slidably directed through the cable sheath having its first end mounted to the thumb socket flange 67, with its second end mounted to primary linkage 71 of the associated drive motor 18. The sheath mounting plate 72 mounts the sheath second end remote from the sheath first end to the motor 18 for positioning the cable second end relative to the carburetor linkage 71 as indicated to provide for ease of engine speed control in use of the invention.

As to the manner of usage and operation of the instant invention, the same should be apparent :from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A motorized skateboard apparatus, comprising, a frame having a first end spaced from a second end, with the first end including a first boot fixedly mounted to the first end projecting thereabove, and a second boot mounted to the frame adjacent the second end extending upwardly from the frame, and a drive motor secured to the frame and positioned between the first boot and the second boot, and a first axle mounted below the frame adjacent the first end, and a second axle mounted below the frame adjacent the second end, and first wheel members mounted to the first axle and second wheel members mounted to the second axle, and drive means in operative communication between the drive motor and the second axle for effecting rotation of the second axle and the second wheel members, and a driving glove, the glove having a thumb socket, the thumb socket having a thumb socket flange secured thereto, and a cable sheath, the cable sheath having a cable sheath first end, the cable sheath first end having a cable sheath first mount secured to the glove spaced from the thumb socket flange, and a cable slidably directed through the cable sheath, with the cable having a first end secured to the thumb socket flange, the cable sheath having a cable sheath second end, the cable sheath second end mounted to the drive motor, and the cable having a cable second end, with the cable second end arranged for securement to a throttle control linkage in operative association with the drive motor.

2. An apparatus as set forth in claim 1 wherein the drive means includes an output pulley mounted to the drive motor and a first driven sprocket positioned below the frame, with the first driven sprocket mounted to a first driven shaft, and a flexible drive belt extending between the output pulley and the first driven sprocket, and a second driven sprocket fixedly mounted to the first driven shaft, and a third driven sprocket mounted to the second axle, with a drive chain extending between the second driven sprocket and the third driven sprocket.

3. An apparatus as set forth in claim 2 wherein the second axle includes a constant velocity joint positioned medially thereof, with the third driven sprocket mounted about the constant velocity joint.

4. An apparatus as set forth in claim 3 wherein the first axle includes a right spindle and a left spindle, with the right spindle and left spindle mounting one of said first wheel members, and the right spindle including a right lower arm spaced below a right upper arm, with a right lower joint and a right upper joint positioned respectively below and above the right spindle, and the left spindle including a left lower arm positioned below the left spindle and a left upper arm positioned above the left spindle, with a left lower joint and a left upper joint positioned respectively below and above the left spindle, and the frame including a right shock tower pivotally mounting the right upper arm and the right shock tower extending above the right upper arm, and a fluid dampener and spring mounted between the right shock tower and the right lower arm, and a left shock tower extending from the frame and projecting above the left upper arm and the left lower arm and the left upper arm pivotally mounted to the left shock tower, and a left fluid dampener and left spring member mounted between the left lower arm and the left shock tower.

* * * * *